United States Patent [19]

Kitsnik

[11] 4,439,112

[45] Mar. 27, 1984

[54] METHOD AND APPARATUS FOR PUMPING VISCOUS AND/OR ABRASIVE FLUIDS

[75] Inventor: Henrik M. Kitsnik, Segmon, Sweden

[73] Assignee: HK-Engineering AB, Sweden

[21] Appl. No.: 225,136

[22] Filed: Jan. 14, 1981

Related U.S. Application Data

[63] Continuation-in-part of Ser. No. 940,646, Sep. 8, 1978, abandoned.

[30] Foreign Application Priority Data

Sep. 9, 1977 [SE] Sweden ..... 7710137

[51] Int. Cl.[3] ..... F04B 17/00

[52] U.S. Cl. ..... 417/383; 417/394; 417/478; 417/900; 91/275

[58] Field of Search ..... 417/383, 389, 390, 394, 417/395, 396, 478, 505, 900; 91/275, 361; 137/845

[56] References Cited

U.S. PATENT DOCUMENTS

| | | | |
|---|---|---|---|
| 2,646,000 | 7/1953 | Schmidt | 417/900 X |
| 2,755,966 | 7/1956 | Lindars | 91/275 X |
| 2,843,050 | 7/1958 | Harper | 91/275 X |
| 2,887,955 | 5/1959 | Owen | 417/900 X |
| 3,035,524 | 5/1962 | Kastner | 417/505 X |
| 3,250,219 | 5/1966 | McCarty et al. | 137/845 |
| 3,250,226 | 5/1966 | Voelker | 417/478 X |
| 3,451,347 | 6/1969 | Chimura | 417/390 |
| 3,918,849 | 11/1975 | Schurenberg | 417/900 X |
| 3,955,557 | 5/1976 | Takagi | 417/389 X |

FOREIGN PATENT DOCUMENTS

| | | | |
|---|---|---|---|
| 796685 | 4/1936 | France | 417/389 |

*Primary Examiner*—Leonard E. Smith

*Attorney, Agent, or Firm*—Ostrolenk, Faber, Gerb & Soffen

[57] ABSTRACT

A method and apparatus for pumping fluids, especially viscous and/or abrasive fluids, are disclosed. The method comprises using one working fluid to pump an intermediate working fluid, which may be different from the first working fluid, through a conduit system in a smooth and continuous pulsating manner. The intermediate fluid pumps the process fluid through the actual pumping zone. Heat exchange between the intermediate and process fluids may be effected, e.g. by counterflow. The preferred apparatus comprises a hydraulically operated displacement pump. A tubular diaphragm pump is coupled in-line in a pipe line. The tubular diaphragm pump includes a housing coupled to the pipe line, and a tubular diaphragm coupled to the housing in such a manner that the process fluid flows from the pipe line, through the interior of the tubular diaphragm and back into the pipe line. A check valve insures that the process fluid passes through the tubular diaphragm in a single direction. The housing is adapted to direct the intermediate working fluid introduced into the housing from a conduit system into contact with the exterior of the tubular diaphragm and back into the conduit. A power section is spaced from the housing and pumps the intermediate fluid through the conduit system and housing in a pulsating, but continuous and smooth, manner.

6 Claims, 8 Drawing Figures

METHOD AND APPARATUS FOR PUMPING VISCOUS AND/OR ABRASIVE FLUIDS

RELATED APPLICATION

This application is a continuation-in-part of copending U.S. patent application Ser. No. 940,646, filed Sept. 8, 1978, for "IMPROVEMENTS IN OR RELATING TO A HYDRAULIC OPERATED DISPLACEMENT PUMP", now abandoned, which is assigned to the assignee of the present application.

BACKGROUND OF THE INVENTION

This invention relates to a method and apparatus for pumping viscous and abrasive fluids, including slurries (hereinafter process fluid). The apparatus may particularly be a hydraulic operated displacement pump adapted to be built into pipe line systems. The method of the present invention comprises using a working fluid to pump the process fluid by means of pumping an intermediate fluid compatible with the process fluid continuously through a conduit system and using the intermediate fluid to force the process fluid through a pumping zone. The apparatus of the present invention preferably comprises a pumping element consisting of at least one tubular diaphragm pump provided with check valves and a power section. The pumping element is an integral part of the pipe line system in which the actual process fluid is to be transported. The power section is a separate unit connected to the pumping element by a conduit system for the intermediate working fluid.

Known pumps of this type are piston-diaphragm pumps and hose-diaphragm-piston pumps. In the first mentioned type of pump, the diaphragm is situated between the working fluid and the process fluid. In the latter type of pump, a tubular flexible separating wall is situated between the working fluid and process fluid and the diaphragm is situated between the first-mentioned working fluid and a second working fluid. Tubular diaphram pumps of this type are characterized by the ability to pump abrasive material, material having a thick consistency, various types of sludge, chemically active fluids, etc. Furthermore, such pumps can be used at very high pump pressures as a result of the hydraulic equilibrium between the working and process fluids. This permits the pumping of higher-density fluids than with centrifugal pumps, which means that a smaller volume of material needs to be pumped (in the case of a slurry) to transport a given amount of solid. This results in lower costs and consumption of less energy per unit of solids. Another advantage of diaphragm pumps over conventional pump types is the lack of movable connections into the process fluid, as a result of which the danger of contamination of the process fluid is greatly diminished. However, due to the fact that the pistons for pressurizing the first and/or second working fluid are mechanically operated, diaphragm pumps are relatively bulky and, as a result, problems often arise in mounting them. Although a tubular diaphragm pump of the foregoing type is usually preferable, it has often been necessary to choose another pump type which is less bulky, although the other pump type is otherwise not as advantageous as a tubular diaphragm pump.

BRIEF DESCRIPTION OF THE INVENTION

The present invention provides a method and apparatus of pumping which employ one working fluid to pump an intermediate working fluid continuously and in a single direction through a conduit system and using the intermediate fluid to pump a process fluid. The intermediate fluid and process fluid are preferably compatible in case of rupture or leakage to minimize danger of contamination. The apparatus may comprise a hydraulic operated displacement pump of the above-described type which requires little space and which is especially well suited to pump very viscous fluids requiring a high discharge pressure, such as high-density iron ore slurries. This is achieved by providing a pumping section which can be built in-line in the process, while the compact, hydraulic power section can be at a location remote from the pumping section. At the same time, the present invention retains the advantages of conventional tubular diaphragm pumps and methods of operating them.

According to the present invention, the conduit system comprises at least one conduit circuit provided with check valves which connect each tubular diaphragm pump to the power section in such a manner that each tubular diaphragm pump constitutes an integral part of the conduit circuit itself and that a continuous and one-way circulation of the intermediate working fluid in the conduit circuit is obtained.

The present invention fulfills the above objects by means of a simple method and by means of an apparatus that is simple and inexpensive to manufacture. Further, the method of the invention is highly reliable, as the drive is provided for example by one or more continuously operating hydraulic pumps coupled together, which deliver high pressure working fluid, the pressure force of which is transferred to the intermediate working fluid (preferably water) through pistons and/or flexible diaphragms in the power section. Thanks to the continuous and smooth one-way circulation of the intermediate working fluid between the power and pumping sections, the losses which occurred in the prior art apparatus in conjunction with changes of direction of the working fluid are eliminated. As a result, the pumping section and the power section may be located at distant positions within the pumping system. This phenomenon can also be used for increasing pump speed.

Additionally, the waterhammer effect (common in the prior art pumps) which arose in the working fluid in conjunction with retardation has been totally eliminated from the invention, due to the fact that the overpressure of that part of the intermediate fluid conduit circuit which serves as a return line is relieved more or less instantaneously.

Yet another advantageous result of the continuous circulation of the working fluid is the fact that the intermediate working fluid can be cooled by the process fluid according to the counterflow principle. Additional cooling or warming of the working fluids can also be provided by a heat exchanger mounted in the circulation circuits of the working fluids.

Other advantages worth mentioning are that the location of the pumping section in-line causes only small flow losses, the power section requires an exceedingly small space, installation is inexpensive, and the separate power section can be constructed very compactly. Since the hydraulic pumps are directly connected to high speed electric motors, there is good accessibility to all essential parts of the system. Since smaller hydraulic pumps are used in the power section, an inexpensive stand-by capacity can be built into the system, and maintenance of the separate pumps can be performed during normal operation of the system with very high reliability in service and shorter down times.

Wear protection in the form of a rubber covering is preferably included in the pumping section and the valves, and there are no moving connections into the process medium. The operation of the pump is independent of the depth in submarine applications. The intermediate fluid is preferably compatible with the process fluid, so that the danger of contamination of the latter in case of a rupture or leak is minimized. Finally, a continuously variable pump capacity can be obtained if one uses variable hydraulic pumps in the power section.

BRIEF DESCRIPTION OF THE DRAWINGS

Other objects and features of the invention will be apparent from the following description and the accompanying drawings.

FIG. 1A shows a perspective view of one example of a check valve that could be used in the pump of FIG. 1.

FIG. 1B shows a longitudinal sectional view of the check valve of FIG. 1A.

FIG. 2 shows an alternative embodiment of the power section of the pump in a vertical section.

DETAILED DESCRIPTION OF THE PREFERRED EMBODIMENTS

Figure 1:
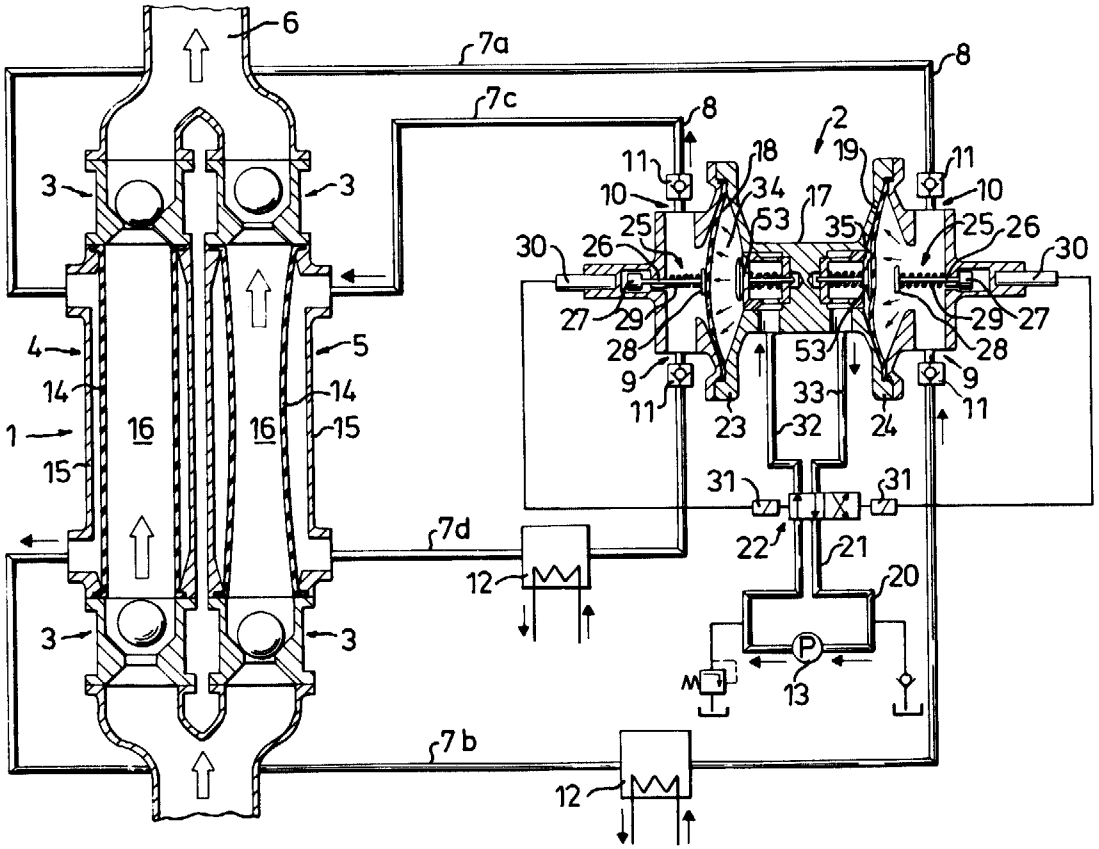
FIG. 1 diagrammatically shows a vertical section through a pump which may be used for carrying out the method of the present invention.
Figure 7A:
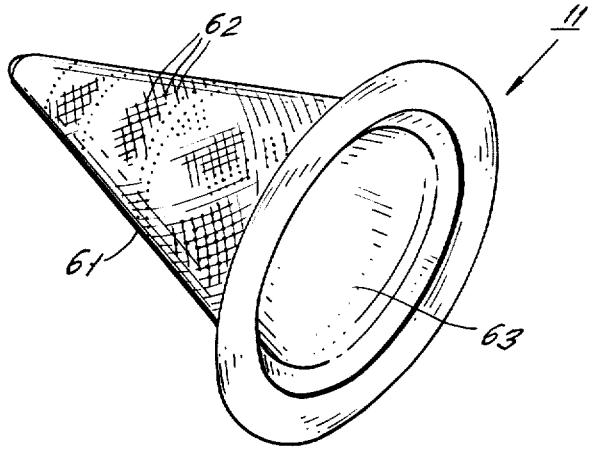
Figure 7B:
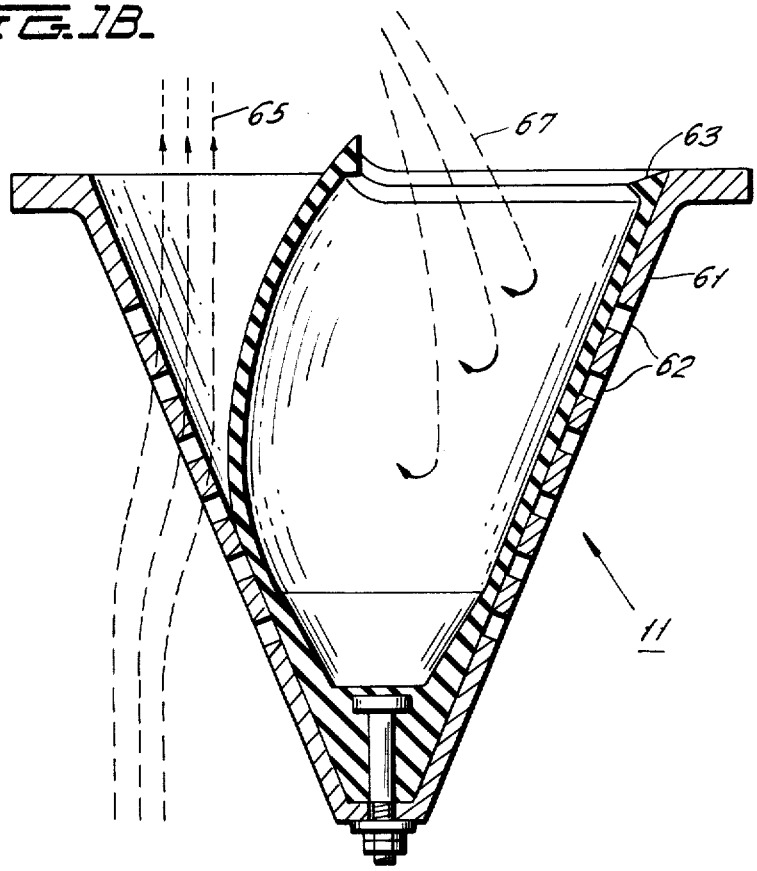
Figure 9:
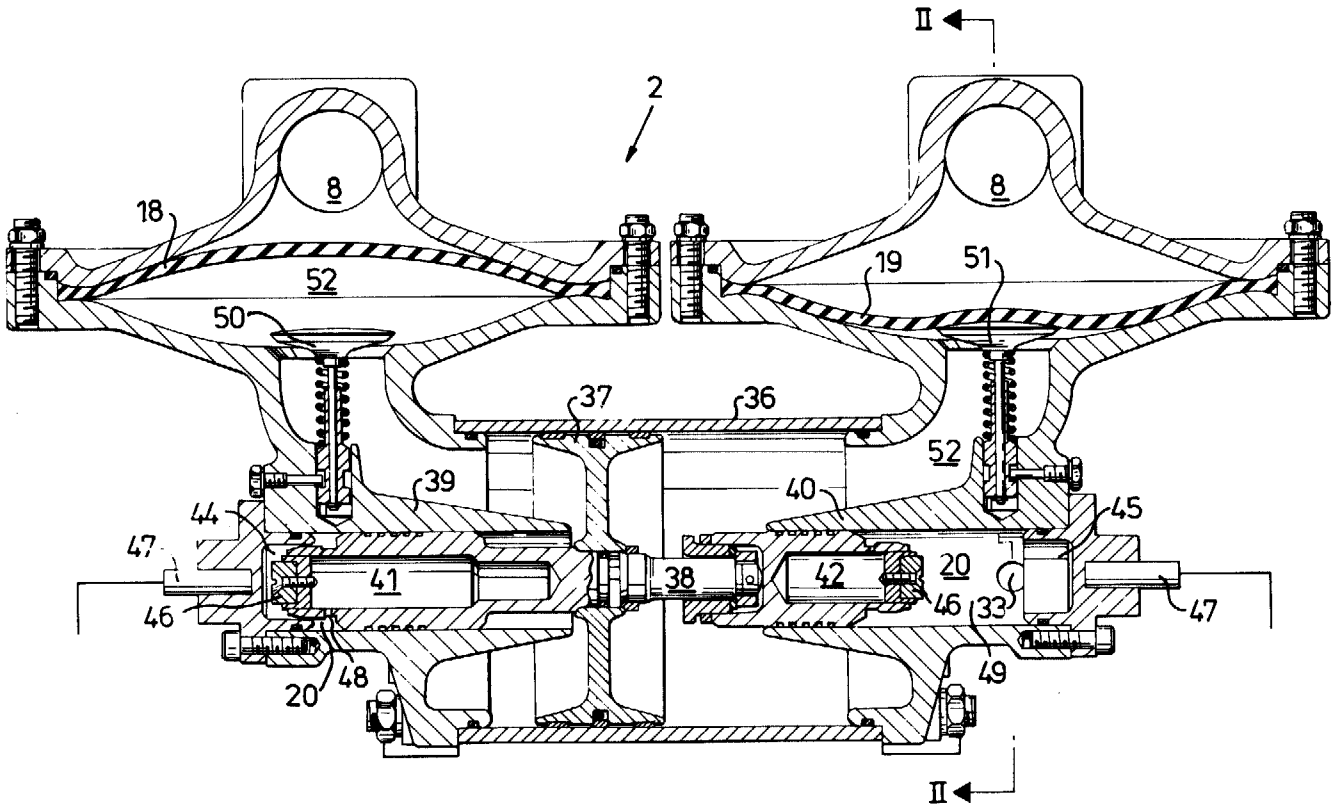

A diagrammatical presentation of a hydraulically operated displacement pump constructed in accordance with the principles of the present invention and for carrying out the method thereof is illustrated in FIG. 1. As shown therein, the pump comprises a pumping section, unit or element 1 and a power section 2. The pumping element 1, which in the example illustrated consists of two tubular diaphragm pumps 4,5 provided with check valves 3, is mounted in-line in a pipe line 6. The pipe line 6 constitutes a part of the pipe line system through which the process medium in question (the fluid being pumped by the system) is to be transported. The pumping element 1 and particularly its tubular diaphragms define the pumping zone, i.e. the location where the process medium is actually pumped.

The power section 2 is a separate unit connected to the pumping element 1 by a first conduit system *7a–d*, which in the example illustrated consists of two conduit circuits *7a, 7b* and *7c, 7d*. One conduit circuit *7a, 7b* connects the power section 2 to one tubular diaphragm pump 4 and the other conduit circuit *7c, 7d* connects the power section 2 to the other tubular diaphragm pump 5, so that a second fluid 8, which is a working fluid (the fluid operating the pump system), in the conduit circuits during the operation of the pump continuously circulates in the conduit system *7a–d*. In order to attain this one-way circulation, check valves 11 are provided in conduit circuits *7a, 7b, 7c, 7d* in the region of the inlet 9 and outlet 10 of the power section 2. One preferred design of the check valves 11 is shown in more detail in FIGS. 1A and 1B. Each valve 11 includes, in the embodiment shown, a conical metal cage 61 whose conical wall has a large number of perforations 62 formed therein and to the interior of which is secured a diaphragm 63 of a light, highly flexible material. The diaphragm 63 lines the interior of the cage 61. Such valves are available, for example, from Axel Larsson Maskinaffar AB (NORVAL non-return valves). As is shown in the left-hand portion of FIG. 1B, the valve 11 opens by means of the diaphragm 63 being forced away from the interior surface of the conical metal cage 61 by a slight net pressure in the direction indicated by arrows 65. When a net pressure is exerted on the diaphragm 63 in the opposite direction, as indicated by the arrows 67 in the right-hand portion of FIG. 1B, the diaphragm 63 is forced firmly against the wall of the cage 61, closing the valve. Because of the great lightness and flexibility of the material of which the diaphragm 63 is made, the valve opens and closes virtually instantaneously in response to the presence of a very small pressure differential across it. Those skilled in the art will appreciate that, in the intermediate fluid circuit *7a, 7b, 7c, 7d*, the check valves 11 will not be subjected to large pressure differentials, due to their rapid operation. It will also be appreciated that, as a result of the substantially instantaneous operation of valves 11, the phenomenon of waterhammer will not occur in the conduit circuit *7a, 7b, 7c, 7d*.

For additional cooling or warming of the working fluid 8 in the conduit system *7a–d* a heat exchanger 12 is connected to each conduit circuit. The working fluid 8 is preferably water, which transfers pressure force from the power section 2, operated by one or more hydraulic pumps 13, to power the pumping movement of the tubular diaphragm pumps 4, 5. The tubular diaphragm pumps 4, 5 are arranged according to the so-called duplex principle, such that the suction stroke of one pump 4 coincides with the pressure stroke of the other pump 5 in order to best use the continuous flow of the hydraulic pumps 13. The tubular diaphragm pumps 4, 5 each consist of a tube diaphragm 14, mounted in a cylindrical housing 15. The ends of the tube diaphragm 14 are fixed between the housing 15 and a check valve 3, so that the inside of the tube diaphragm 14 only contacts process medium 16 and its outside only contacts the working fluid 8.

The pressure force from the hydraulic power section 2 is transmitted to the working fluid 8 via flexible diaphragms or flexible diaphragms and pistons.

In FIG. 1 the pressure force is transmitted to the working fluid 8 by flexible diaphragms, while in FIGS. 2–5 the pressure force is transmitted to the working fluid 8 by flexible diaphragms and pistons.

The power section 2 illustrated in FIG. 1 comprises a second conduit system that includes, in addition to hydraulic pump 13, two movable diaphragms 18 and 19 situated in a common diaphragm casing 17 and conduits 20–22, 32 and 33 joining casing 17 to hydraulic pump 13. The diaphragms 18, 19 are alternately actuated by the pressure force from a third fluid (second working fluid) 20, for example hydraulic oil. The fluid 20 continuously flows in one direction through a conduit 21 connected to a flow reversing valve 22. The diaphragms 18 and 19 are each provided in a house 23 and 24 in the diaphragms casing 17 and contact, in their outer end positions, indicators 25. Indicators 25 consist of a shaft 26 having a magnet 27 at one end and a plate 28 at the other. Indicators 25 are reciprocated in casing 17 by the combined action of spring 29 and diaphragms 18 and 19. When displaced by a respective diaphragm 18 or 19, the magnet 27 of the respective indicator 25 actuates a position indicator 30, of the type lacking contacts, which sends a signal to a solenoid 31 for switching over the reversing valve 22 and reversing the flow of the working fluid 20 in first and second conduits 32 and 33. Conduits 32 and 33 apply the working fluid 20 to spaces 34 and 35 in the houses 23 and 24 via spring damping valves 53 which serves to prevent overload and rupture of the rubber diaphragms 18, 19 when they are in their inner end positions.

Figure 3:
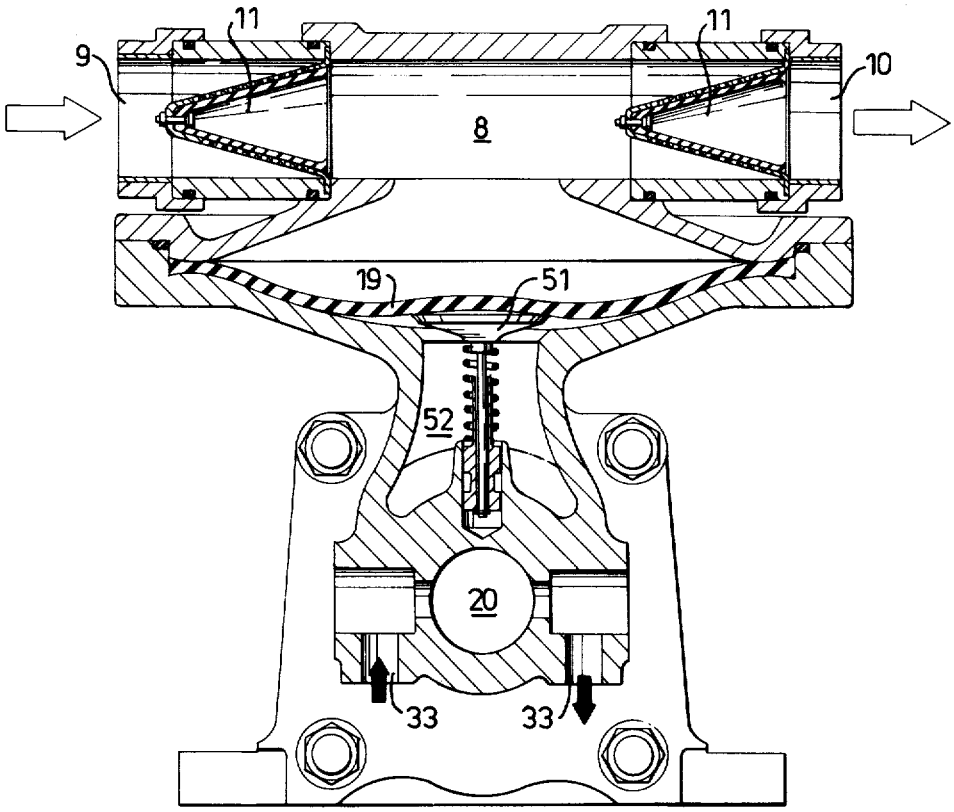
FIG. 3 shows a section along the line II—II of the embodiment illustrated in FIG. 2.
Figure 4:
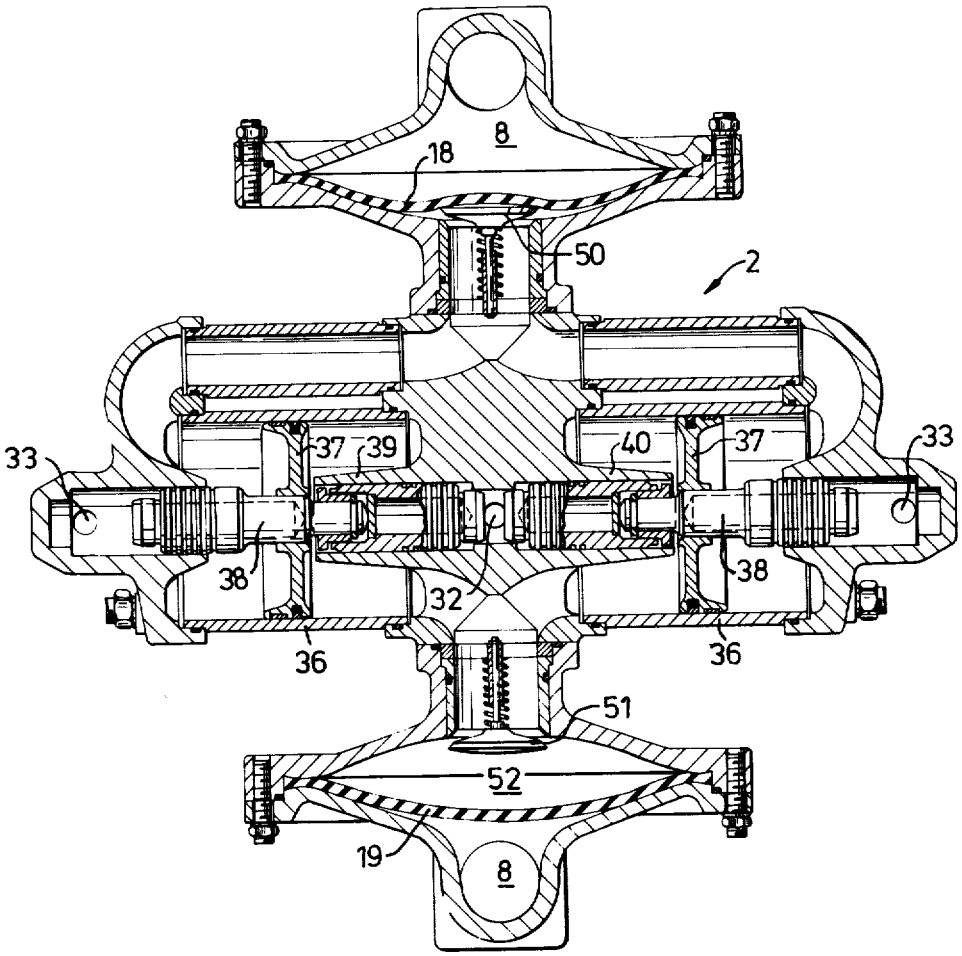
FIG. 4 shows a vertical section of another embodiment of the power section of the pump.

In FIGS. 2–4 two pumps employing the hydraulic exchange principle are illustrated. In each example, the capacity and pressure of the third fluid (the second working fluid) are transmitted to a higher flow and lower pressure in the second and first fluids (the intermediate working fluid and process fluid, respectively). This is attained by different working areas for respective fluids (the flows during the pump stroke are proportional to the area ratio). Thus the compact high pressure system in the power section 2 also can be used for relatively large pump flows.

In FIG. 2 diaphragms 18 and 19 are actuated by the third fluid (second working fluid) 52 which is enclosed between the diaphragms 18, 19 and a piston 37 displaceable in a main cylinder 36 and sealed against the same. The piston (and therefore the working fluid 52) is in turn actuated by the additional working fluid 20. The piston 37 is provided with piston rod 38 extending from the middle of the piston 37 and along the direction of movement of the piston 37. The piston rod 38 extends through the main cylinder 36*b* and into power pistons 41, 42 which are movable in the power cylinders 39, 40, respectively. The free end of power pistons 41, 42 are formed conically to cooperate with cylindrical openings 44, 45, provided in the outer ends of the power cylinders 39 and 40. At the end positions of the piston rod 38, one attains an effective end position damping when the power pistons 41, 42 enter the openings 44, 45. Magnetic pieces 46 are mounted at the free end of the power pistons 41 and 42 for actuating position indicators 47 provided near the bottom of the openings 44, 45. The indicators 47 send impulses to the reversing valve 22 for switching over the valve when the power pistons 41, 42 and the piston 37 are in their end positions. The additional working fluid 20 alternately flows in the conduits 32 and 33, which open, respectively, into spaces 48, 49 of power cylinders 39 and 40. Since the free ends of the power pistons 41, 42 are located in spaces 48, 49, respectively, the working fluid initiates reciprocating movement of the piston 37.

FIG. 3 shows a section along the line II—II of the power section 2 of the pump illustrated in FIG. 2. This figure illustrates how the conduits 32 and 33 of the working fluid 20 are connected. In the example illustrated in FIGS. 2 and 3, the diaphragms 18, 19, which are actuated by the third fluid (second working fluid) 52, are in the same way as the example illustrated in FIG. 1 protected by spring actuated valves 50 and 51 to prevent overload and rupture of the rubber diaphragms after having reached their respective end position. FIG. 3 illustrates the connection of one of the circuits to the power section 2 and the location of the light-weight, fast-acting check valves 11 in the inlet 9 and outlet 10.

FIG. 4 shows the power section 2 of the pump in an example provided with two pistons 37. This arrangement is preferable in that the unbalanced inertial forces from the moving parts are eliminated and less vibrations are produced. In this embodiment, the pistons 37 move at the same time in a direction toward and from each other.

Figure 5:
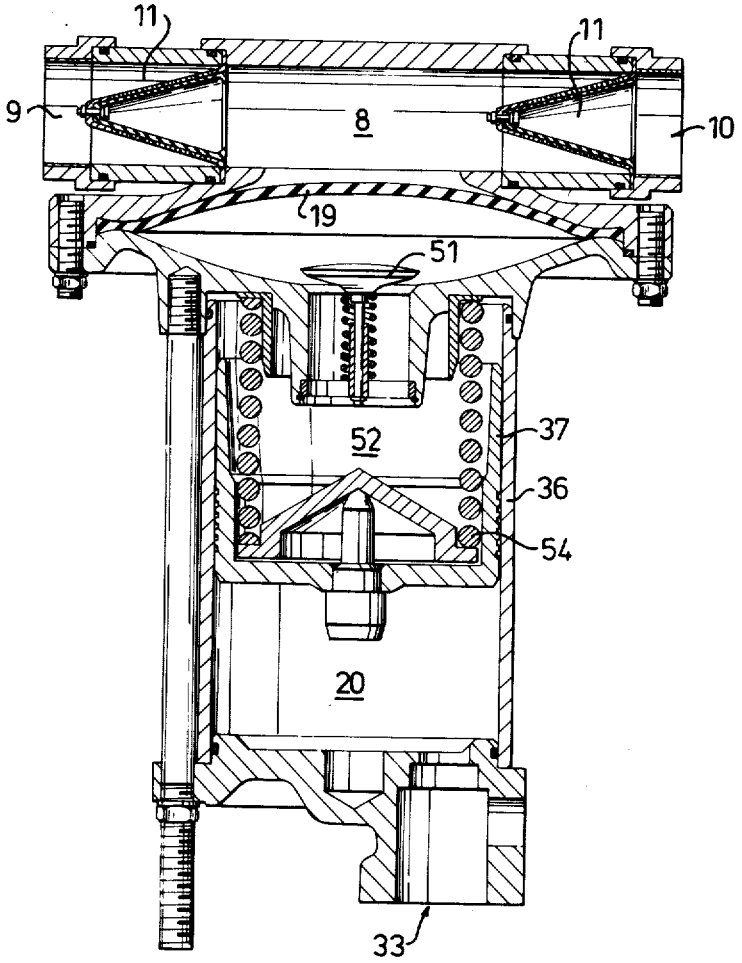
FIG. 5 shows a vertical section of still another variant of one of the diaphragm casings included in the power section.

FIG. 5 shows an embodiment of the pump in which the piston 37 is returned to its initial position during the suction stroke with the aid of a helical spring 54. In this Figure, only one of the two pumping sections of the power section is illustrated. Here the intermediate (second) fluid 20 is only turned on one side of the piston 37 and the ratio is 1:1.

Figure 6:
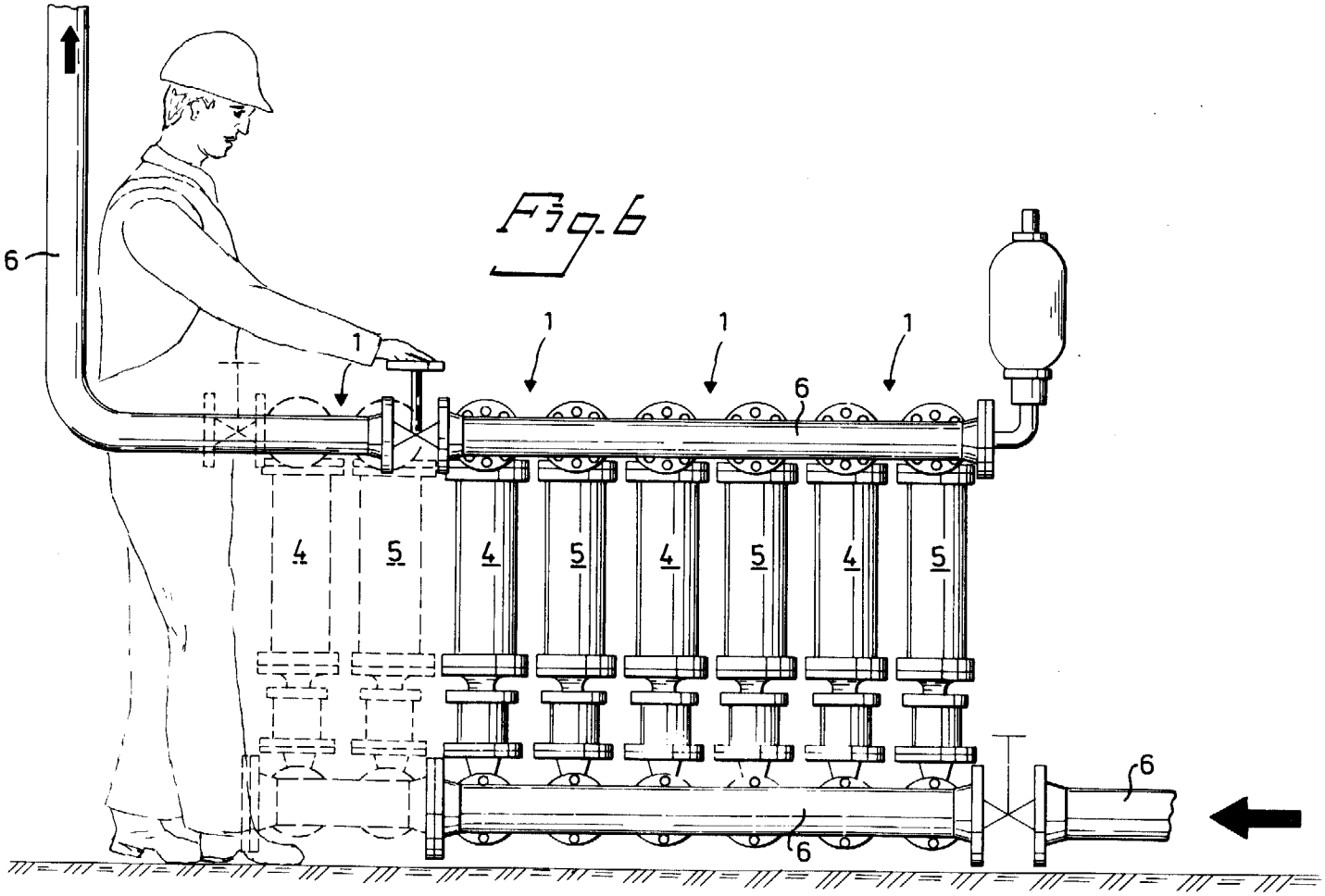
FIG. 6 shows an application of pumping elements mounted in pairs.

Finally, FIG. 6 illustrates an application of the pumping elements 1 mounted in pairs. As shown in phantom, it is very easy to connect a pair of stand-by pumping elements to the existing plant. In pump plants of the types which are now commonly in use, it is necessary to provide stand-by units which are used during failure of the main pumps. As a result, the cost of the plant is doubled. Utilizing the present invention, it is sufficient to provide one stand-by unit for example during replacement of a pumping tube or pumping valve. The stand-by unit is connected to the ordinary system and therefore only an additional cost of about 25% or less is required.

It will be appreciated from the foregoing that the method of the invention comprises pumping a working fluid through a hydraulic system, which can be remote from the pipe line through which the process medium is to be pumped, and using the working fluid to pump an intermediate fluid through a conduit system to actuate a pump element located in-line in the pipe line. The intermediate fluid, unlike the other working fluid (also referred to above as the third fluid), is pumped in a single direction, and is pumped sufficiently smoothly and continuously that waterhammer effects are altogether absent from the intermediate fluid system, resulting in lower power requirements and lower operating costs.

Since the iron ore content of the slurry ranged from 0 to as high as 70% by weight, the density of the slurry pumped was as high as 2.3 tons per cubic meter. The maximum particle size was about 1 millimeter.

A series of practical tests was carried out using the method of the present invention under actual industrial conditions to pump a slurry of iron ore concentrate and water. The iron ore concentrate used in the test had a density of 4.9 tons per cubic meter. During the test, the pump discharge pressure was varied between 5 and 15 bars, which latter value corresponds to a pressure of 15 bars in the intermediate fluid and about 160 bars in the high pressure hydraulic system (the third fluid). The upper limit of 15 bars was due to the limitations of the testing facilities and not of the pump. The pumping capacity can be varied by means of the variable delivery hydraulic pump used in the driving section of the preferred embodiment of the apparatus of the invention. Maximum operating capacity was 145 liters per minute, which was obtained at a stroking frequency of 1.6 (double) strokes per second.

The pump characteristics were essentially unaffected by the flow properties of the process fluid, which ranged from water to the high density slurry described in the preceding paragraph. No operational problems were encountered even with an iron ore concentration of 70% by weight and at a discharge pressure of 15 bars. Pump efficiency improved with increasing discharge pressure and reached a value of 70% for discharge pressures over 12 bars. The maximum operating capacity, 145 meters per minute, at a given stroke frequency, 1.6 per second, indicates a volumetric efficiency in excess of 90%.

The present invention may be embodied in other specific forms without departing from the spirit or essential attributes thereof and, accordingly, reference should be made to the appended claims, rather than to the foregoing specification, as indicating the scope of the invention.

What is claimed is:

1. A process for pumping a viscous or abrasive aqueous fluid, comprising the steps of:

(a) passing said fluid in one direction through an expanding and contracting pumping zone;

(b) actuating said pumping zone by a second aqueous fluid caused to flow continuously and smoothly through a conduit system having valve means responsive to small pressure differentials adjacent to said pumping zone so as to cause said pumping zone to respond hydraulically to the movement of said second fluid; and (c) actuating said second fluid by hydraulic pressure from a third non-aqueous fluid.

2. A hydraulically operated displacement pumping system for pumping a first fluid through a pipe line, said displacement pump comprising:

(A) a tubular diaphragm pump coupled in series with said pipe line, said tubular diaphragm pump including:

(1) a housing coupled to said pipe line;

(2) a tubular diaphragm coupled to said housing so that said first fluid flows from said pipe line, through the interior of said tubular diaphragm, and back into said pipe line;

(3) check valve means for insuring that said first fluid passes through said tubular diaphragm in only one direction; and (4) said housing directing a second fluid introduced into said housing into contact with the exterior of said tubular diaphragm;

(B) a power section spaced from said housing for pumping said second fluid in a pulsating manner; said power section including a high pressure pump for pumping a third fluid and further including means for transferring pressure and momentum from said third fluid to said second fluid to effect said pumping of said second fluid in said pulsating manner; and (C) conduit means connecting said power section to said housing in such a manner that said second fluid is pumped from said power section to said housing and into contact with said exterior of said tubular diaphragm whereby said tubular diaphragm pulsates and thereby pumps said first fluid through said pipe line; said conduit means including additional check valve means for causing said second fluid to pass through said conduit means in a single direction, opposite to said one direction, and for causing said second fluid to pass through said conduit means in a sufficiently smooth and continuous manner to avert losses due to said second fluid stopping and starting in said conduit means while said pump is in operation; said additional check valve means comprising a conical perforated member having secured to the interior thereof a flexible diaphragm, said additional check valve means being rapidly responsive to pressure differentials.

3. The hydraulically operated displacement pumping system of claim 2, wherein said power section comprises:

a housing;

said means for transferring pressure and momentum including a flexible diaphragm dividing said power section housing into first and second chambers;

second conduit means for guiding said third fluid between said high pressure pump and said second chamber; and flow reversing valve means coupled to said second conduit means for causing said third fluid to alternately flow into and out of said second chamber whereby a pulsating force is applied to said second fluid located in said first chamber.

4. The hydraulically operated displacement pumping system of claim 3, wherein said power section further includes:

a second flexible diaphragm dividing said power section housing into third and fourth chambers, said conduit means coupling said tubular diaphragm pump housing to said third chamber such that said second fluid flows through said third chamber;

said second conduit means also for guiding said third fluid between said high pressure pump and said fourth chamber; and second flow reversing valve means coupled to said second conduit means for causing said third fluid to alternately flow into and out of said fourth chamber whereby a pulsating force is applied to said second fluid located in said third chamber.

5. The hydraulically operated displacement pumping system of claim 2, wherein said power section comprises:

a housing;

said momentum and pressure transfer means including a first flexible diaphragm dividing said housing into first and second chambers, said conduit means coupling said tubular diaphragm pump housing to said first chamber such that said second fluid flows between said first chamber and said tubular diaphragm housing;

a second flexible diaphragm dividing said housing into third and fourth chambers, conduit means coupling said tubular diaphragm pump housing to said third chamber such that said second fluid flows through said third chamber;

said second and fourth chambers being filled with additional fluid and being separated from each other by a piston which reciprocates through a piston cylinder which defines part of said second and fourth chambers;

said reciprocal piston having first and second end portions extending from opposite ends threreof, said first and second end portions extending into fifth and sixth chambers of said housing, respectively, and defining first and second power pistons;

second conduit means for guiding said third fluid between said high pressure pump and said fifth and sixth chambers; and flow reversing valve means coupled to said second conduit means for causing said third fluid to alternately flow into and out of both of said fifth and sixth chambers, said flow reversing valve means to control the flow of said third fluid in such a manner that when said third fluid is flowing into one of said fifth and sixth chambers it is flowing out of the remaining one of said fifth and sixth chambers.

6. The hydraulically operated displacement pumping system of claim 5, wherein said reciprocating piston and said power piston are so related that the flow rate of said third fluid in said fifth and sixth chambers is converted into higher flow rates of said additional fluid in said second and fourth chambers.

* * * * *